US008727587B2

(12) United States Patent
Chen

(10) Patent No.: US 8,727,587 B2
(45) Date of Patent: May 20, 2014

(54) CONTROLLABLE ON/OFF DEVICE FOR AN AUXILIARY LIGHT

(76) Inventor: Chao-Ming Chen, Taichung (TW)

( * ) Notice: Subject to any disclaimer, the term of this patent is extended or adjusted under 35 U.S.C. 154(b) by 177 days.

(21) Appl. No.: 13/565,623

(22) Filed: Aug. 2, 2012

(65) Prior Publication Data

US 2014/0036520 A1 Feb. 6, 2014

(51) Int. Cl.
*F21V 21/28* (2006.01)
*F21V 17/12* (2006.01)

(52) U.S. Cl.
USPC ..... 362/428; 362/249.09

(58) Field of Classification Search
USPC ..... 362/249.09, 428
See application file for complete search history.

(56) References Cited

U.S. PATENT DOCUMENTS 8,297,808 B2 * 10/2012 Yuan ..... 362/428

* cited by examiner

*Primary Examiner* — Stephen F Husar
*Assistant Examiner* — James Cranson, Jr.

(57) ABSTRACT

A controllable on/off device for an auxiliary light contains: a lamp module having a body in which a driving unit connecting with an illuminating element, the body including a first conducting piece coupling with a cathode contact point of the driving unit and a second conducting piece coupling with a negative contact point of the driving unit; a base fixed under the lamp module and including a conduction element corresponding to the first conducting piece and the second conducting piece; a pivotal clutch mechanism defined between the lamp module and the base so that the lamp module is axially rotated and shifted between a first rotating range and a second rotating range and drives the lamp module to move vertically, such that the first conducting piece and the second conducting piece are driven to contact with or leave from the conduction element, thus turning on or off the illuminating element.

10 Claims, 11 Drawing Sheets

CONTROLLABLE ON/OFF DEVICE FOR AN AUXILIARY LIGHT

FIELD OF THE INVENTION

The present invention relates to a controllable on/off device for an auxiliary light in which a lamp module is axially rotated and shifted between a first rotating range and a second rotating range to be further turned on or off an illuminating element of the lamp module easily.

BACKGROUND OF THE INVENTION

Referring to FIGS. 1 and 2, a conventional auxiliary light for a tool disclosed in TW Publication No. 386966 contains a base 11, a light set with two bulbs 12, and a tool lamp 10 comprised of two conductive magnet elements 13, 14. The base 11 is connected with the light set and includes the two bulbs 12 fixed on an outer end surface thereof and an inversely V-shaped slot 111 defined thereon to receive the two conductive magnet elements 13, 14. The two conductive magnet elements 13, 14 are obliquely opposite to each other and electrically couple with the light set to form two unconducted electrical contacts. The tool lamp 10 matches with a hand tool 20 with an electric conductivity and is attached on the hand tool 20 by using the two conductive magnet elements 13, 14, and the hand tool 20 contacts with the two conductive magnet elements 13, 14 to turn on the two bulbs 12 of the light set, thus illuminating lights. Besides, the tool lamp 10 allows being removed so that the two conductive magnet elements 13, 14 leave from the hand tool 20 to break the circuit, thereby turning off the two bulbs 12 of the light set. However, a turning on/off of the tool lamp 10 still has the following defects:

1. The two bulbs 12 are turned on or off by attaching the two conductive magnet elements 13, 14 on the hand tool 20 or removing the two conductive magnet elements 13, 14 from the hand tool 20 repeatedly, thus having inconvenient operation.
2. After removing the tool lamp 10, it is placed carelessly, thus losing the tool lamp 10 easily.
3. When the tool lamp 10 is attached on the hand tool 20, a light illumination angle of the tool lamp 10 can not be adjusted based on using requirement.
4. The tool lamp 10 electrically conducts with the hand tool 20 by ways of the two conductive magnet elements 13, 14 to turn on the two bulbs 12. But if other tools or objects do not have electric conductivity or magnetism, they can not match with the tool lamp 10, thus limiting usage.

The present invention has arisen to mitigate and/or obviate the afore-described disadvantages.

SUMMARY OF THE INVENTION

The primary object of the present invention is to provide a controllable on/off device for an auxiliary light in which a lamp module is axially rotated and shifted between a first rotating range and a second rotating range to be further turned on or off an illuminating element of the lamp module easily.

Another object of the present invention is to provide a controllable on/off device for an auxiliary light in which a pivotal clutch mechanism is defined between the lamp module and the base so that the lamp module is axially rotated and shifted between a first rotating range and a second rotating range and drives the lamp module to move upwardly and downwardly, such that the first conducting piece and the second conducting piece of the lamp module are driven to contact with or leave from the conduction element, thus turning on or off the illuminating element.

To obtain the above objective, a controllable on/off device for an auxiliary light provided by the present invention contains:

a lamp module having a body in which a driving unit is disposed and connects with an illuminating element, the body including a first conducting piece for conducting electricity fixed on a bottom surface thereof and coupling with a cathode contact point of the driving unit, and a second conducting piece secured on the bottom surface thereof and coupling with a negative contact point of the driving unit;

a base fixed under the lamp module and including a conduction element corresponding to the first conducting piece and the second conducting piece and having an electric conductivity;

a pivotal clutch mechanism defined between the lamp module and the base so that the lamp module is axially rotated and shifted between a first rotating range and a second rotating range and drives the lamp module to move upwardly and downwardly, such that the first conducting piece and the second conducting piece of the lamp module are driven to contact with or leave from the conduction element, thus turning on or off the illuminating element.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
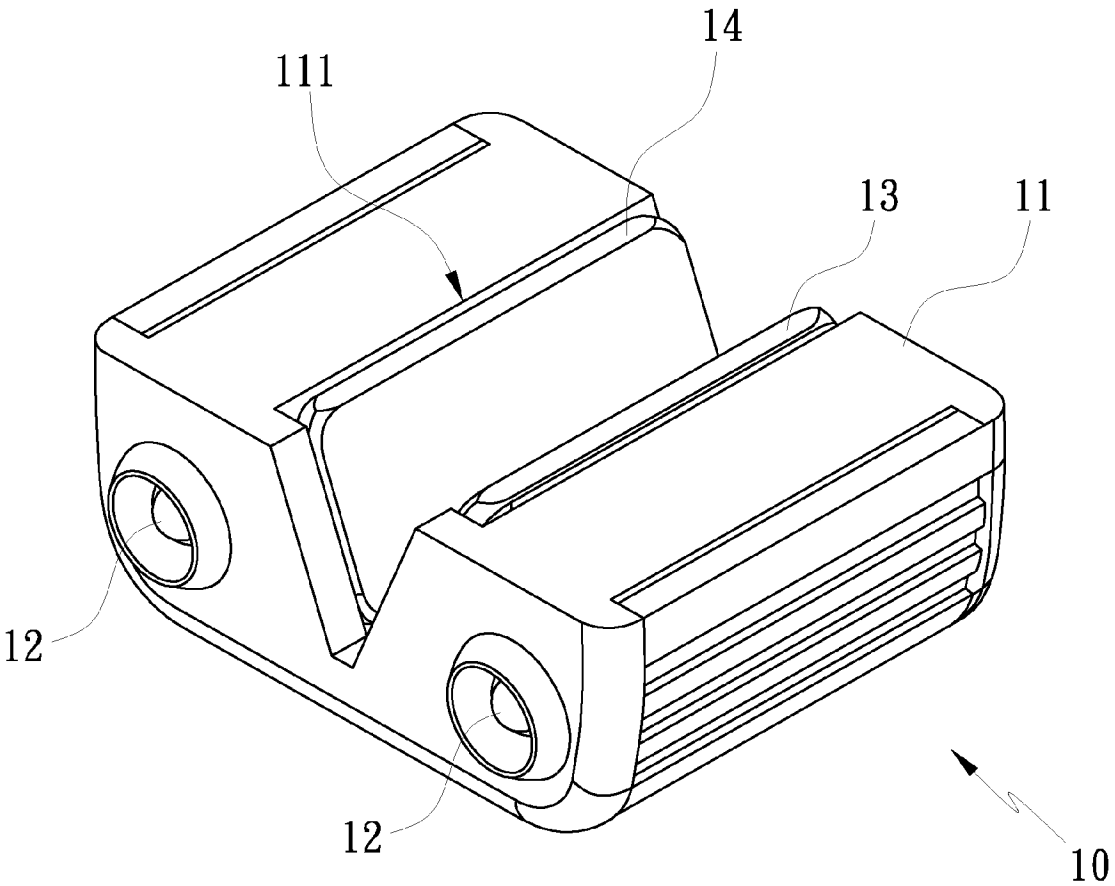
FIG. 1 PRIOR ART
FIG. 1 is a perspective view showing the assembly of a conventional auxiliary light for a tool disclosed in TW Publication No. 386966.
Figure 2:
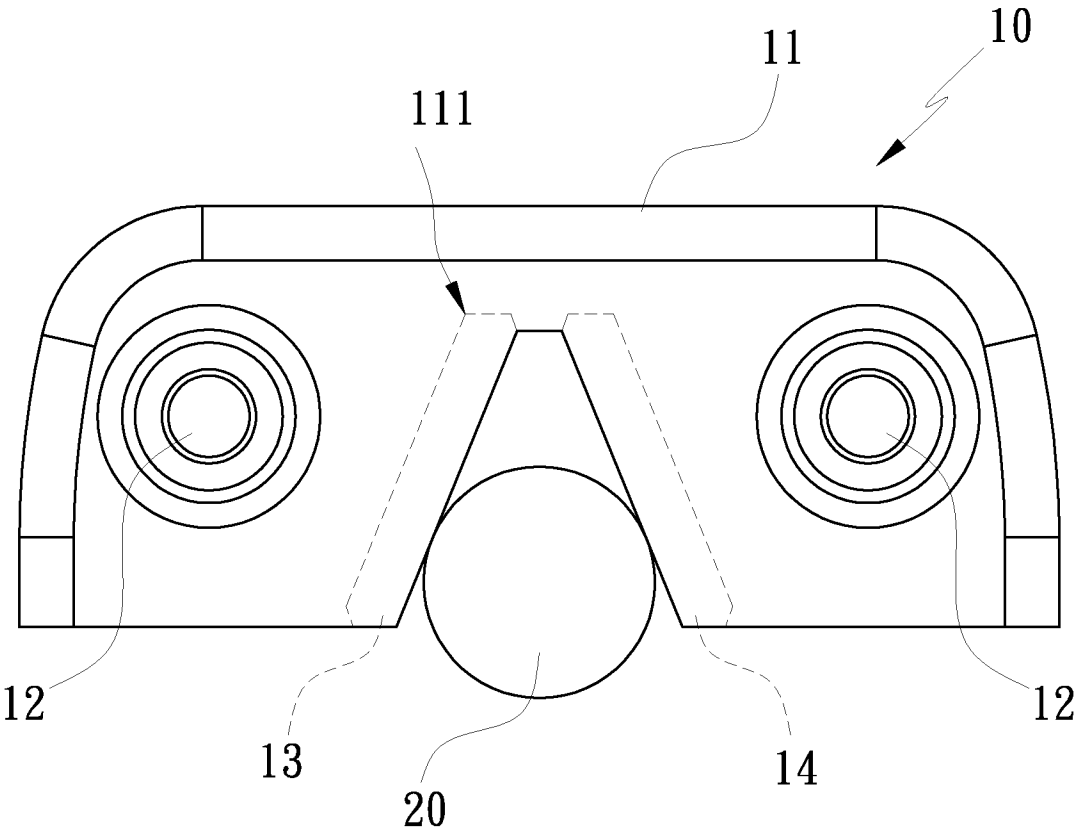
FIG. 2 PRIOR ART
FIG. 2 is a side plan view showing the operation of the conventional auxiliary light for the tool disclosed in TW Publication No. 386966.
Figure 3:
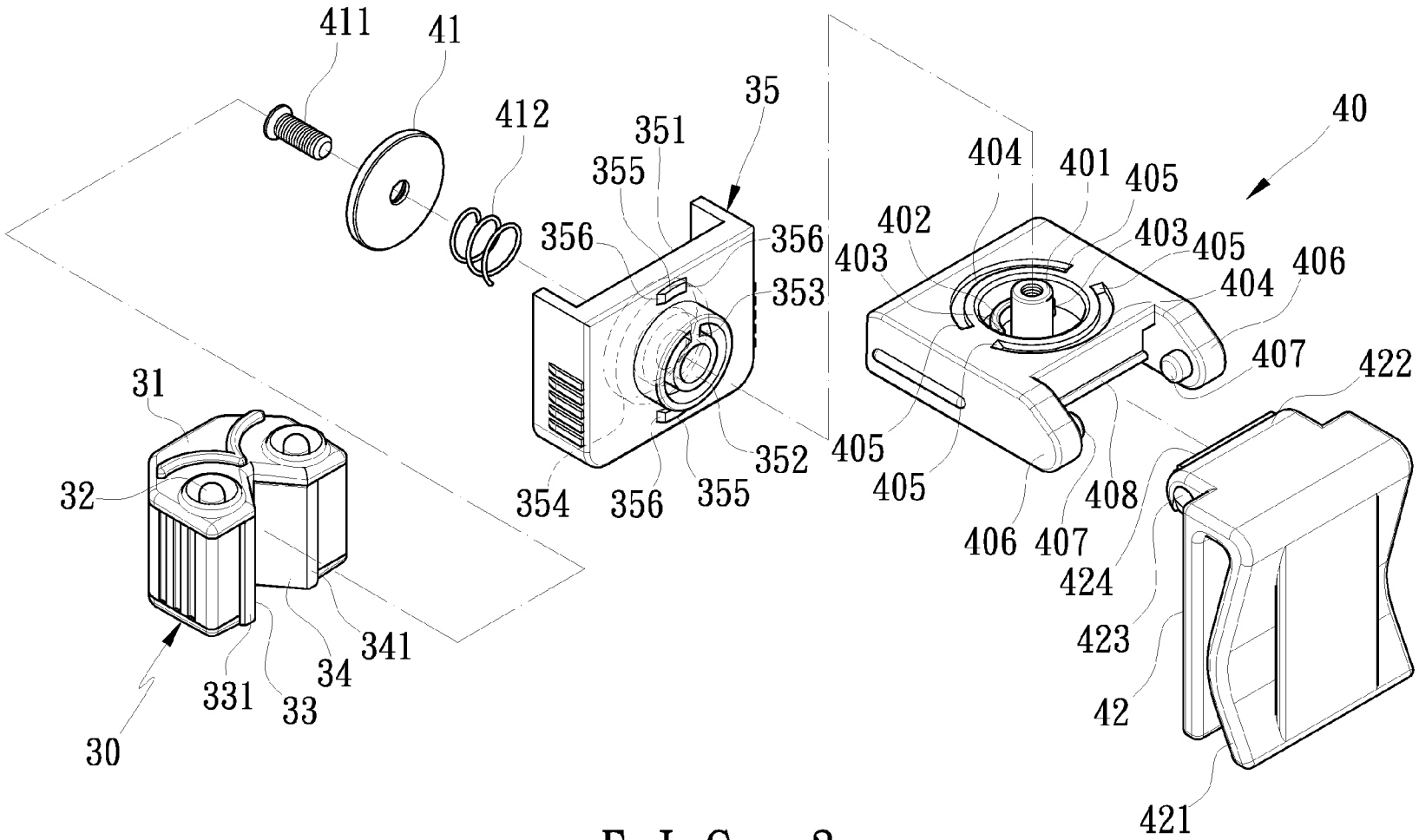
FIG. 3 is a perspective view showing the exploded components of a controllable on/off device for an auxiliary light according to a preferred embodiment of the present invention.

With reference to FIGS. 3-7, a controllable on/off device for an auxiliary light according to a preferred embodiment of the present invention comprises a lamp module 30 having a body 31 in which a driving unit is disposed and connects with a cell set, the body 31 includes an illuminating element 32 (such as a LED light) mounted on one end thereof to emit lights, a first conducting piece 33 for conducting electricity fixed on a bottom surface thereof and coupling with a cathode contact point of the driving unit, and a second conducting piece 34 secured on the bottom surface thereof and coupling with a negative contact point of the driving unit. In this embodiment, the first conducting piece 33 and the second conducting piece 34 have an electric conductivity, and the first conducting piece 33 has a first conductive portion 331 defined on a bottom end thereof, the second conducting piece 34 has a second conducive portion 341 defined on a bottom end thereof. A base 40 is fixed under the lamp module 30 and includes a conduction element 41 corresponding to the first conducting piece 33 and the second conducting piece 34 and having an electric conductivity and magnetism, between the lamp module 30 and the base 40 is defined a pivotal clutch mechanism so that the lamp module 30 is axially rotated and shifted between a first rotating range A and a second rotating range B and is driven to move upwardly and downwardly, such that the first conducting piece 33 and the second conducting piece 34 of the lamp module 30 are driven to contact with or leave from the conduction element 41, thus turning on or off the illuminating element 32 of the lamp module 30. In this embodiment, the pivotal clutch mechanism includes an axial rotating seat 35, the axial rotating seat 35 has a connecting portion 351 formed on a top surface thereof to receive the lamp module 30, and the connecting portion 351 has a pivoting portion 352 defined thereon, the pivoting portion 352 is a through hole. The base 40 also includes a first axial coupling portion 401 (i.e., an axial shaft) mounted on a top surface thereof to connect with the pivoting portion 352 of the connecting portion 351 so that the axial rotating seat 35 is axially rotated and shifted on the base 40. Between the axial rotating seat 35 and the base 40 is defined a limiting structure so that the axial rotating seat 35 and the lamp module 30 are limited between the first rotating range A and the second rotating range B of the base 40. In this embodiment, the limiting structure includes a rib 402 arranged on one side of the first axial coupling portion 401 of the base 40 and having two defining portions 403 defined on two ends of the rib 402, and a shoulder 353 formed on one side of the pivoting portion 352 of the axial rotating seat 35, such that the two defining portions 403 of the base 40 stop the shoulder 353 of the axial rotating seat 35 so that the axial rotating seat 35 and the lamp module 30 are limited between the first rotating range A and the second rotating range B to axially rotate and shift. In addition, the connecting portion 351 of the axial rotating seat 35 has a receiving groove 354 defined thereon and communicate with the pivoting portion 352 to receive the conduction element 41 which is locked on the first axial coupling portion 401 of the base 40 by a screw bolt 411. The axial rotating seat 35 also has two guiding protrusions 355 arranged on two sides of a bottom surface thereof between which the pivoting portion 352 is defined, and each guiding protrusion 355 has two inclined faces 356 defined on two ends thereof. The base 40 further includes two slots 404 defined on the top surface thereof and corresponding to the two guiding protrusions 355 of the axial rotating seat 35, and each slot 404 has two tilted pushing faces 405 defined on two ends thereof, such that when the lamp module 30 and the axial rotating seat 35 are axially rotated to shift toward the first rotating range A, the two guiding protrusions 355 of the axial rotating seat 35 are received in the two slots 404 of the base 40, and a top end of the conduction element 41 extends out of the receiving groove 354 of the axial rotating seat 35 to contact with the first conducting piece 33 and the second conducting piece 34 of the lamp module 30 so that the cathode contact point and the negative contact point of the driving unit of the lamp module 30 conduct to turn on the illuminating element 32 of the lamp module 30, and the two guiding protrusions 355 of the axial rotating seat 35 axially rotate in the two slots 404 of the base 40 so that a light illumination angle of the lamp module 30 is adjusted in a horizontal direction. Besides, when the lamp module 30 and the axial rotating seat 35 are axially rotated to shift toward the second rotating range B, four inclined faces 356 of the two guiding protrusions 355 of the axial rotating seat 35 push four tilted pushing faces 405 of the two slots 404 of the base 40 so that the lamp module 30 and the axial rotating seat 35 are driven to move upwardly, and the conduction element 41 is received in the receiving groove 354 of the axial rotating seat 35, hence the first conducting piece 33 and the second conducting piece 34 of the lamp module 30 move upwardly with the axial rotating seat 35 to leave from the conduction element 41, and the cathode contact point and the negative contact point of the driving unit of the lamp module 30 break to turn off the illuminating element 32 of the lamp module 30. Between the conduction element 41 and the receiving groove 354 of the axial rotating seat 35 is defined a resilient element 412 (such as a spring), and when the lamp module 30 and the rotating seat 35 are axially rotated to shift toward the first rotating range A, the resilient element 412 pushes the lamp module 30 and the axial rotating seat 35 to move downwardly so that the first conducting piece 33 and the second conducting piece 34 of the lamp module 30 contact with the conduction element 41. The base 40 also includes a connection structure to connect with various tools or objects, and a light illumination is provided by the lamp module 30. In this embodiment, the connection structure includes two tabs 406 formed on one end thereof and each tab 406 having a stem 407, a clamping member 42 with a retaining piece 421 extending outwardly from one end of the clamping member 42 to retain the base 40 on the tools or the objects and with a second axial coupling portion 422 extending outwardly from another end of the clamping member 42 and having an orifice 423 so that the second axial coupling portion 422 is axially connected between the two tabs 406 of the base 40. Between the two tabs 406 of the base 40 is defined a flexible locking portion 408, the second axial coupling portion 422 of the clamping member 42 has a plurality of engaging extensions 424 arranged thereon, such that the retaining piece 421 retains the base 40 on the tools or the objects, and the locking portion 408 of the base 40 engages with the plurality of engaging extensions 424 of the clamping member 42 so that the light illumination angle of the lamp module 30 is adjusted in a vertical direction.

Figure 4:
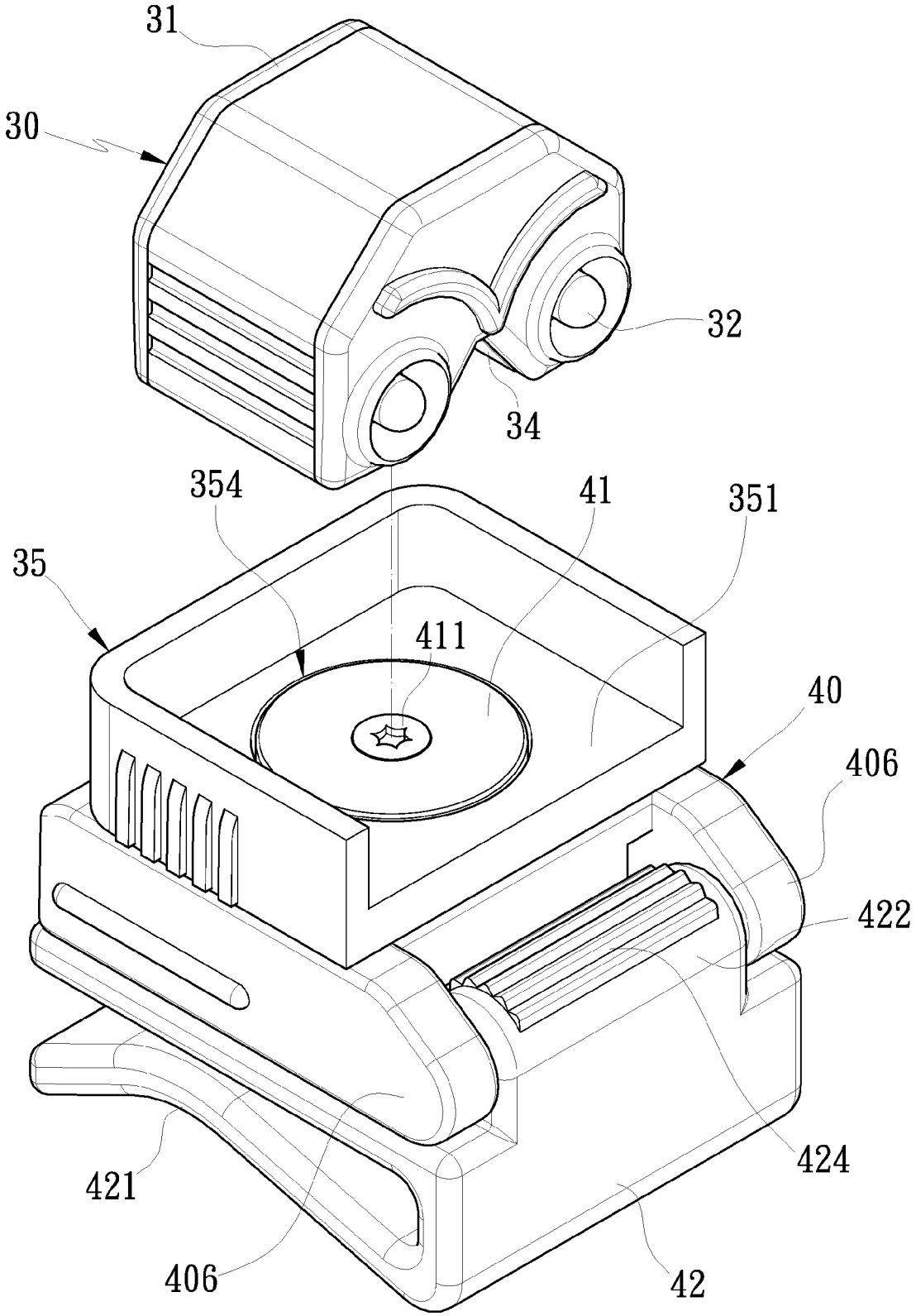
FIG. 4 is a perspective view showing the assembly of the controllable on/off device for the auxiliary light according to the preferred embodiment of the present invention.
Figure 6:
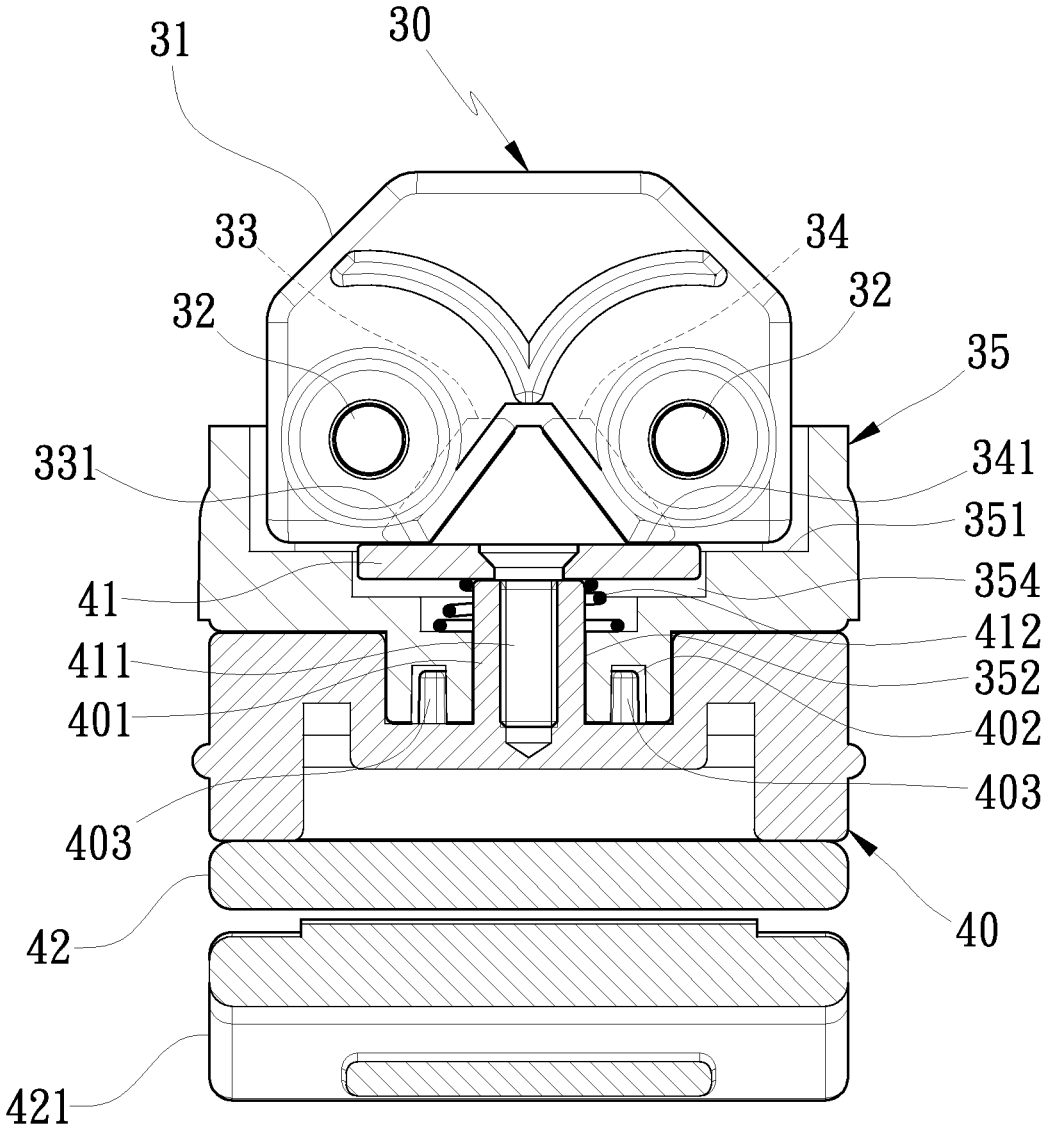
FIG. 6 is a cross sectional view showing the assembly of the controllable on/off device for the auxiliary light according to the preferred embodiment of the present invention.

Referring further to FIGS. 4 and 6, in operation, the lamp module 30 is placed into the connecting portion 351 of the axial rotating seat 35, due to the conduction element 41 has a magnetism, and a magnetic effect exists among the first conducting piece 33 and the second conducting piece 34 of the lamp module 30 and the conduction element 41, the lamp module 30 is attracted in the connecting portion 351 of the axial rotating seat 35 and is retained on the tools or the other objects (such as a cap) by ways of the retaining piece 421 of the clamping member 42.

Figure 5:
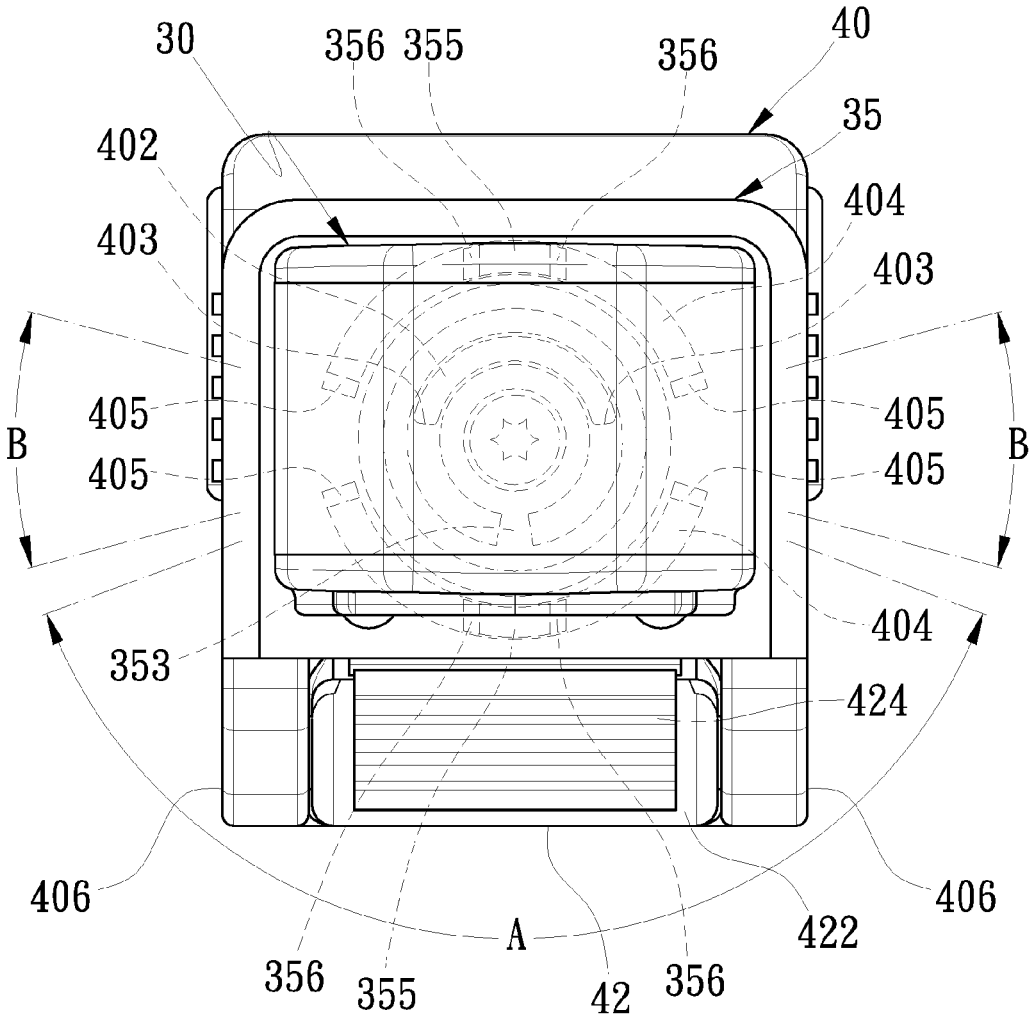
FIG. 5 is a plan view showing the assembly of the controllable on/off device for the auxiliary light according to the preferred embodiment of the present invention.
Figure 7:
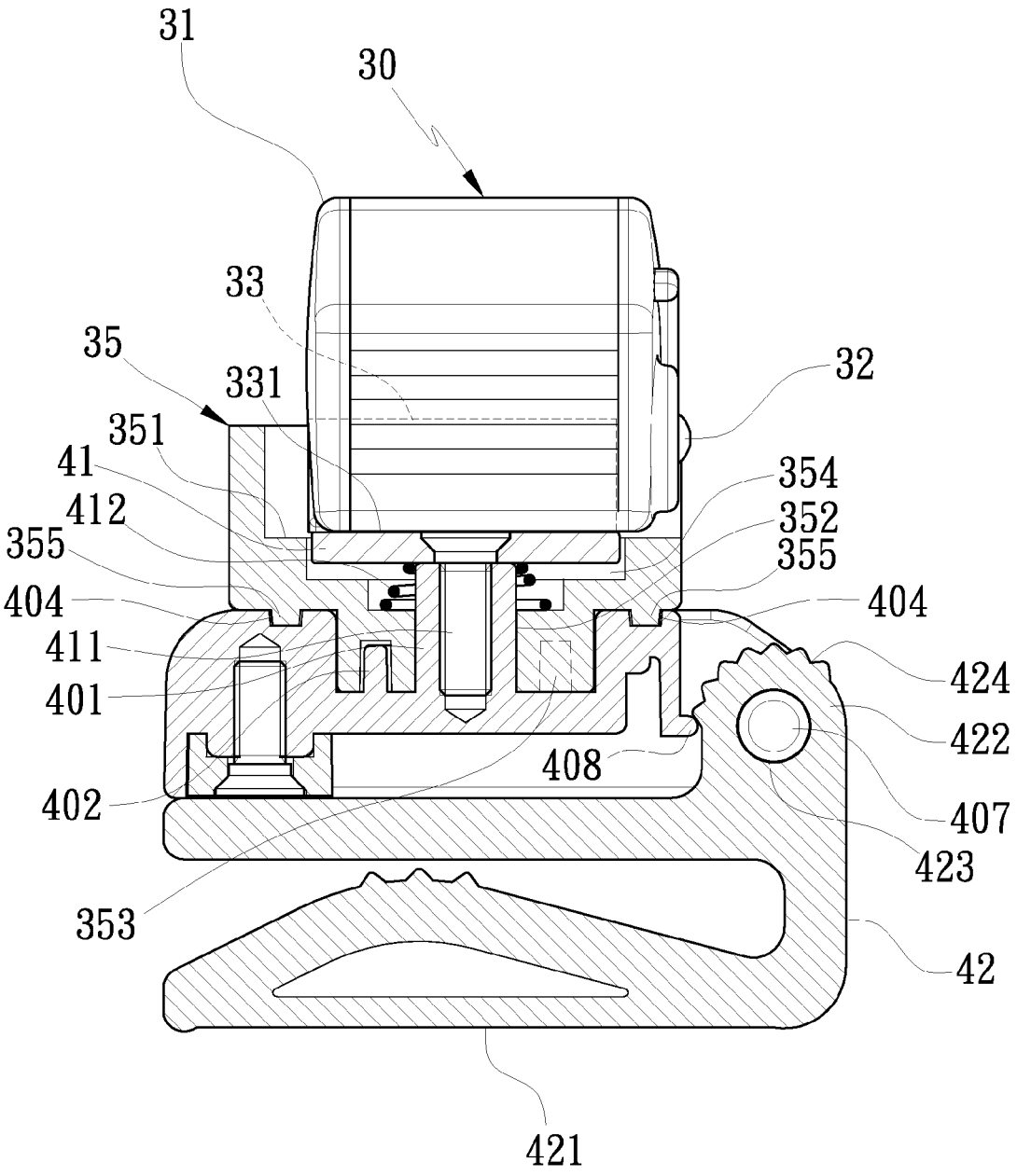
FIG. 7 is another cross sectional view showing the assembly of the controllable on/off device for the auxiliary light according to the preferred embodiment of the present invention.

Referring further to FIGS. 5-7, after the lamp module 30 is attracted in the connecting portion 351 of the axial rotating seat 35, the lamp module 30 and the axial rotating seat 35 are located at the first rotating range A, the two guiding protrusions 355 of the axial rotating seat 35 are received in the two slots 404 of the base 40, and the top end of the conduction element 41 extends out of the receiving groove 354 of the axial rotating seat 35 to contact with the first conductive portion 331 of the first conducting piece 33 and the second conductive portion 341 of the second conducting piece 34 so that the cathode contact point and the negative contact point of the driving unit of the lamp module 30 is conducted to turn on the illuminating element 32 of the lamp module 30, and the two guiding protrusions 355 of the axial rotating seat 35 axially rotate in the two slots 404 of the base 40, the locking portion 408 of the base 40 engages with the plurality of engaging extensions 424 of the clamping member 42, such that when the lamp module 30 is turned on, the light illumination angle of the lamp module 30 is adjusted horizontally and vertically.

Figure 8:
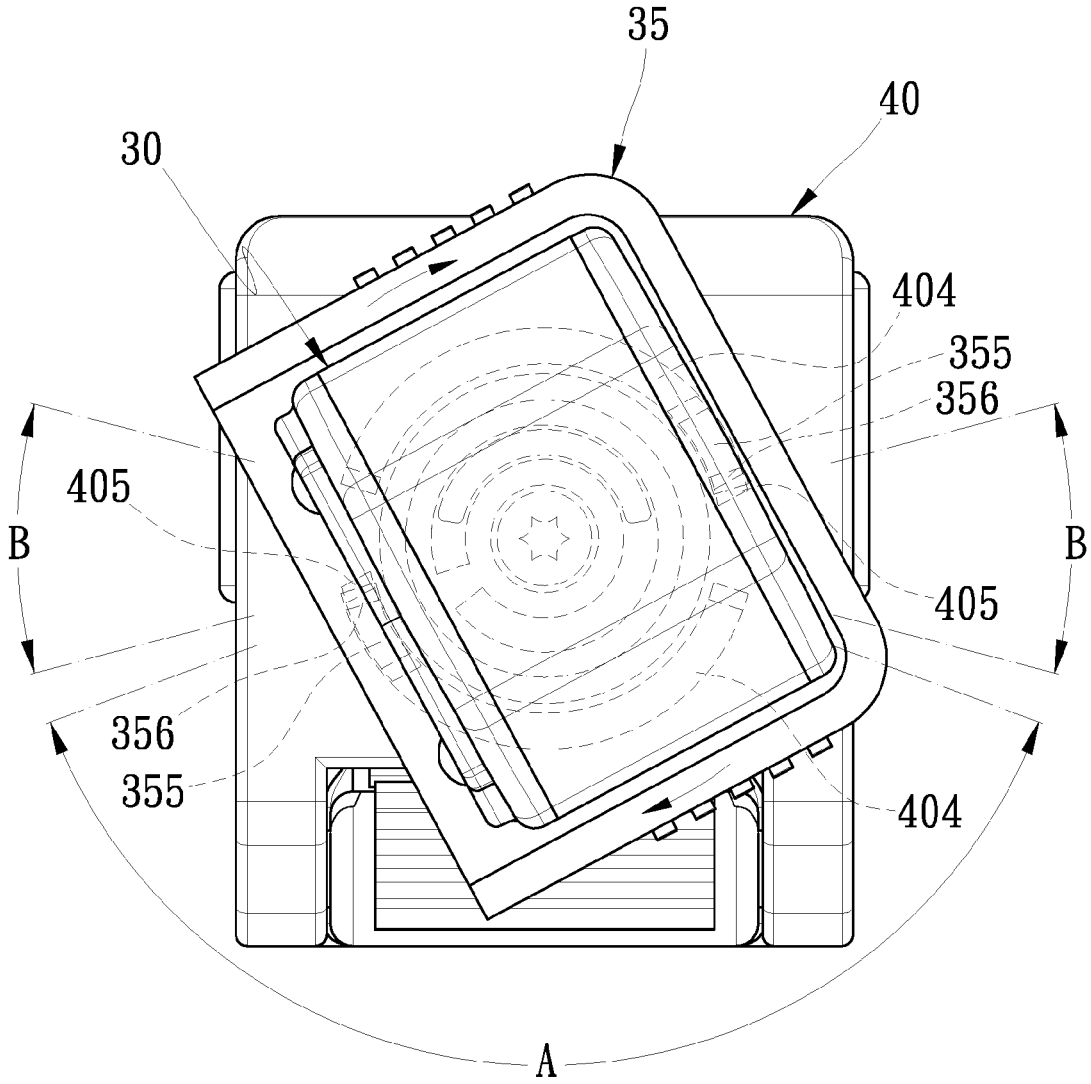
FIG. 8 is a plan view showing the operation of the controllable on/off device for the auxiliary light according to the preferred embodiment of the present invention.
Figure 9:
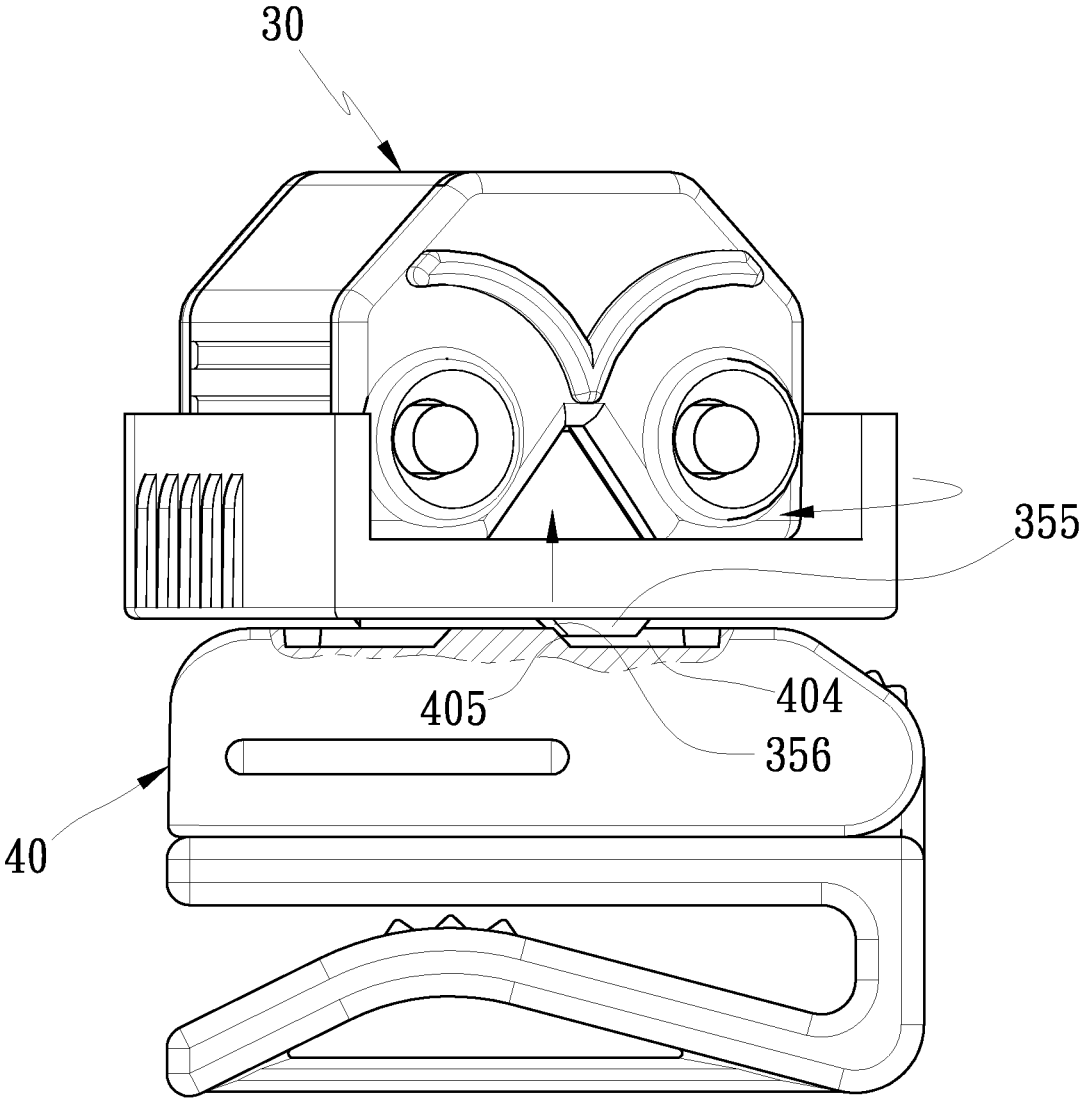
FIG. 9 is another plan view showing the operation of the controllable on/off device for the auxiliary light according to the preferred embodiment of the present invention.
Figure 10:
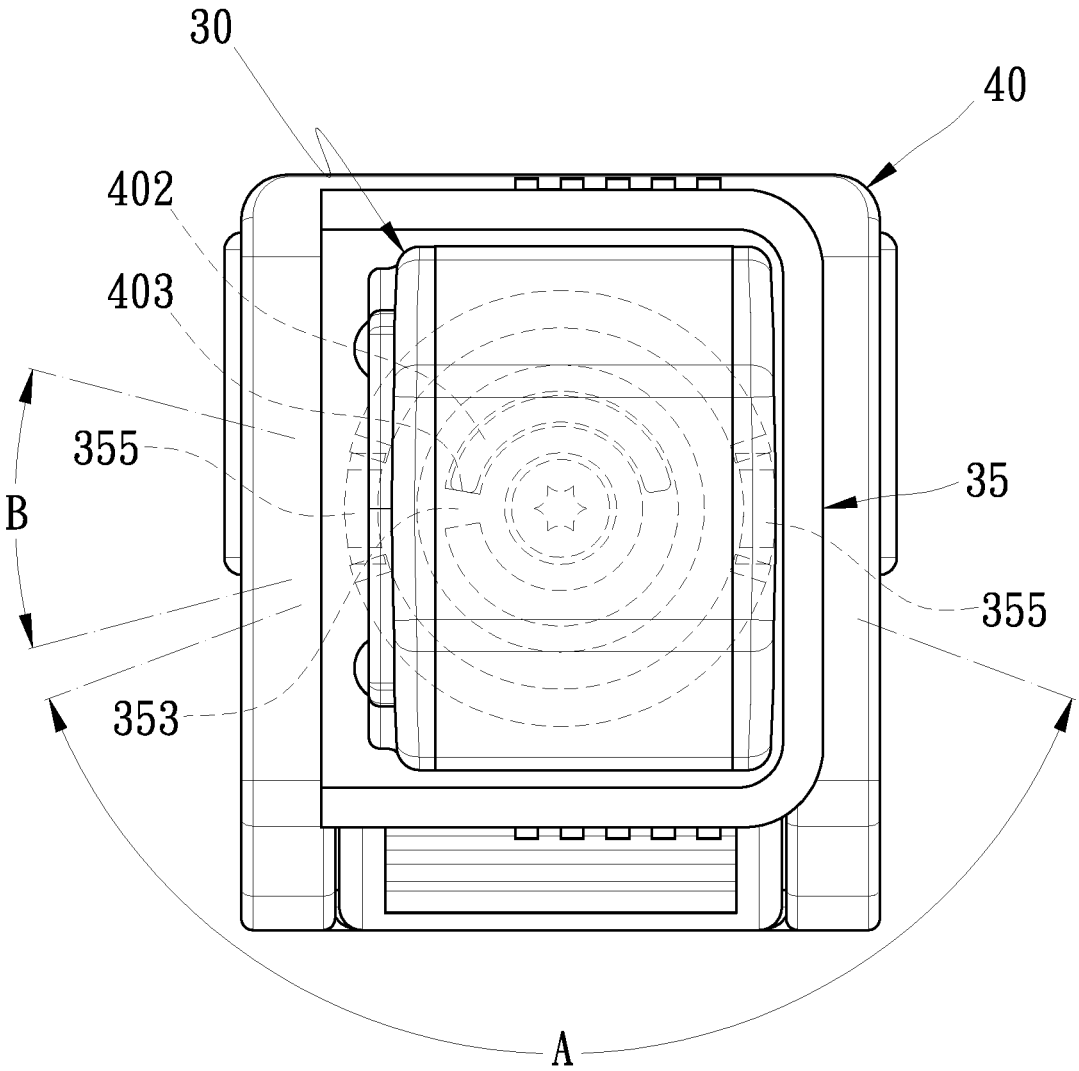
FIG. 10 is still another plan view showing the operation of the controllable on/off device for the auxiliary light according to the preferred embodiment of the present invention.
Figure 11:
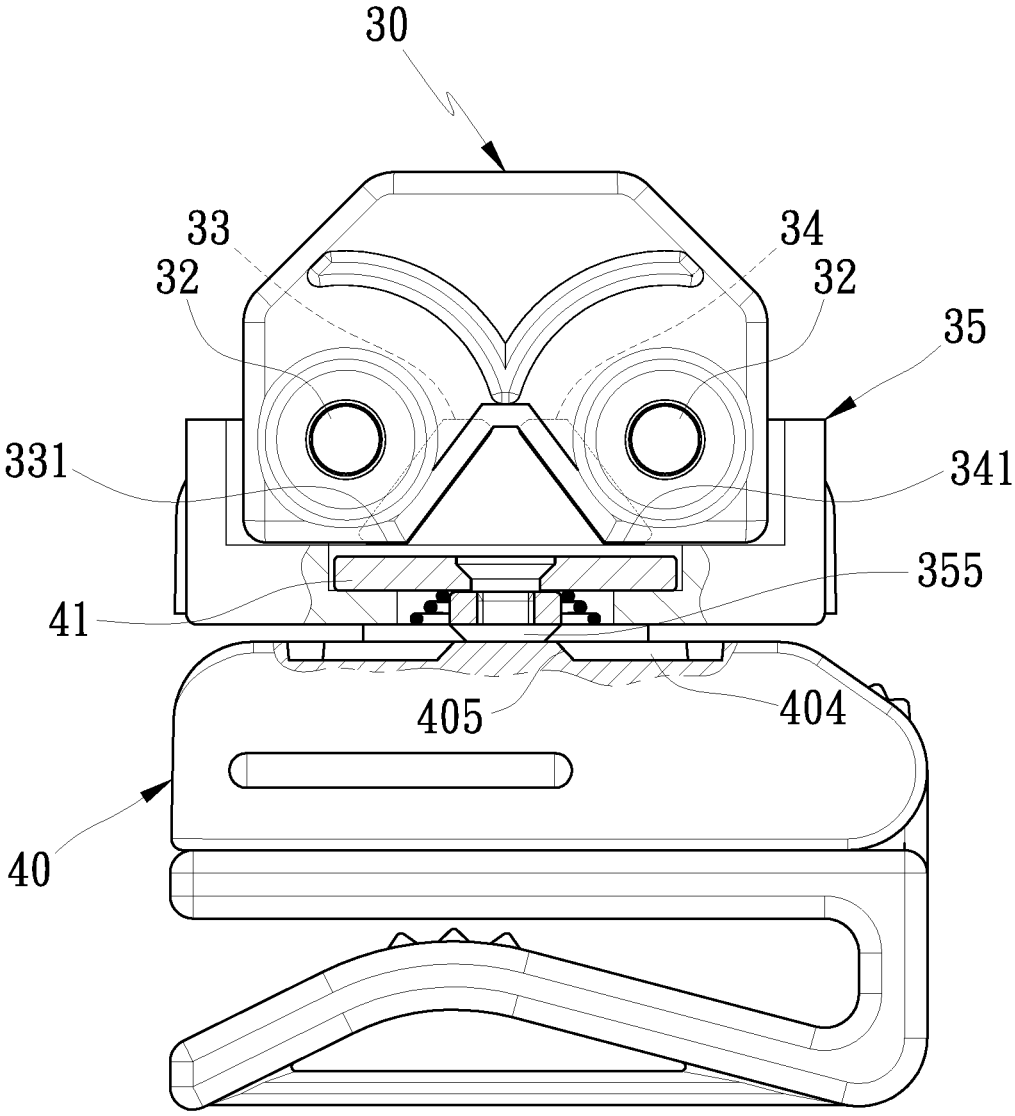
FIG. 11 is also another plan view showing the operation of the controllable on/off device for the auxiliary light according to the preferred embodiment of the present invention.

As shown in FIGS. 8 and 9, when desiring to turn off the lamp module 30, the lamp module 30 and the axial rotating seat 35 are axially rotated to shift toward the second rotating range B, and as the four inclined faces 356 of the two guiding protrusions 355 of the axial rotating seat 35 move to push the four tilted pushing faces 405 of the two slots 404 of the base 40, the lamp module 30 and the axial rotating seat 35 are driven to move upwardly. Referring further to FIGS. 10 and 11, when the lamp module 30 and the axial rotating seat 35 are axially rotated and shifted continuously, the two defining portions 403 of the base 40 stop the shoulder 353 of the axial rotating seat 35 so that the two guiding protrusions 355 of the axial rotating seat 35 move upwardly and fix on the top surface of the base 40, and the conduction element 41 is received in the receiving groove 354 of the axial rotating seat 35, hence the first conducting piece 33 and the second conducting piece 34 of the lamp module 30 move upwardly with the axial rotating seat 35 to leave from the conduction element 41, and the cathode contact point and the negative contact point of the driving unit of the lamp module 30 break to turn off the illuminating element 32 of the lamp module 30. In addition, the lamp module 30 is attracted in the connecting portion 351 of the axial rotating seat 35 by means of the magnetic effect among the first conducting piece 33 and the second conducting piece 34 of the lamp module 30 and the conduction element 41, so after the first conducting piece 33 and the second conducting piece 34 of the lamp module 30 remove form the conduction element 41, the lamp module 30 is still attracted in the connecting portion 351 of the axial rotating seat 35.

Thereby, after the lamp module 30 is axially rotated and shifted between the first rotating range A and the second rotating range B and is driven to move upwardly and downwardly, the first conducting piece 33 and the second conducting piece 34 of the lamp module 30 are driven to contact with or leave from the conduction element 41, thus turning on or off the illuminating element 32 of the lamp module 30 easily.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A controllable on/off device for an auxiliary light comprising:

a lamp module having a body in which a driving unit is disposed and connects with an illuminating element, the body including a first conducting piece for conducting electricity fixed on a bottom surface thereof and coupling with a cathode contact point of the driving unit, and a second conducting piece secured on the bottom surface thereof and coupling with a negative contact point of the driving unit;

a base fixed under the lamp module and including a conduction element corresponding to the first conducting piece and the second conducting piece and having an electric conductivity;

a pivotal clutch mechanism defined between the lamp module and the base so that the lamp module is axially rotated and shifted between a first rotating range and a second rotating range and drives the lamp module to move upwardly and downwardly, such that the first conducting piece and the second conducting piece of the lamp module are driven to contact with or leave from the conduction element, thus turning on or off the illuminating element.

2. The controllable on/off device for the auxiliary light as claimed in claim 1, wherein the first conducting piece and the second conducting piece of the lamp module have an electric conductivity, and the first conducting piece has a first conductive portion defined on a bottom end thereof, the second conducting piece has a second conducive portion defined on a bottom end thereof.

3. The controllable on/off device for the auxiliary light as claimed in claim 1, wherein the conduction element of the base has magnetism, and the lamp module is attracted in the connecting portion of the axial rotating seat by means of a magnetic effect among the first conducting piece and the second conducting piece of the lamp module and the conduction element.

4. The controllable on/off device for the auxiliary light as claimed in claim 1, wherein the pivotal clutch mechanism includes an axial rotating seat to receive the lamp module, the axial rotating seat has a pivoting portion defined thereon, the base also includes a first axial coupling portion mounted on a top surface thereof to connect with the pivoting portion of the connecting portion, the connecting portion of the axial rotating seat has a receiving groove defined thereon and communicate with the pivoting portion to receive the conduction element which is locked on the first axial coupling portion of the base by a screw bolt, the axial rotating seat also has two guiding protrusions arranged on two sides of a bottom surface thereof between which the pivoting portion is defined, and each guiding protrusion has two inclined faces defined on two ends thereof, the base further includes two slots defined on the top surface thereof and corresponding to the two guiding protrusions of the axial rotating seat, and each slot has two tilted pushing faces defined on two ends thereof, such that when the lamp module is axially rotated and shifted between the first rotating range and the second rotating range, four inclined faces of the two guiding protrusions of the axial rotating seat push four tilted pushing faces of the two slots of the base so that the lamp module is driven to move upwardly and downwardly to drive the first conducting piece and the second conducting piece of the lamp module to contact with or leave from the conduction element, thus turning on or off the illuminating element of the lamp module.

5. The controllable on/off device for the auxiliary light as claimed in claim 4, wherein the axial rotating seat has a connecting portion formed on a top surface thereof to receive the lamp module.

6. The controllable on/off device for the auxiliary light as claimed in claim 4, wherein between the axial rotating seat and the base is defined a limiting structure, the limiting structure includes a rib arranged on one side of the first axial coupling portion of the base and having two defining portions defined on two ends of the rib, and a shoulder formed on one side of the pivoting portion of the axial rotating seat, such that the two defining portions of the base stop the shoulder of the axial rotating seat so that the axial rotating seat and the lamp module are limited between the first rotating range and the second rotating range to axially rotate and shift.

7. The controllable on/off device for the auxiliary light as claimed in claim 4, wherein between the conduction element and the receiving groove of the axial rotating seat is defined a resilient element so that when the lamp module and the rotating seat are axially rotated to shift toward the first rotating range, the resilient element pushes the lamp module and the axial rotating seat to move downwardly so that the first conducting piece and the second conducting piece of the lamp module contact with the conduction element.

8. The controllable on/off device for the auxiliary light as claimed in claim 4, wherein the conduction element is locked on the first axial coupling portion of the base by a screw bolt.

9. The controllable on/off device for the auxiliary light as claimed in claim 1, wherein the base also includes a connection structure to connect with a tool or an object, the connection structure includes two tabs formed on one end thereof and each tab having a stem, a clamping member with a retaining piece extending outwardly from one end of the clamping member to retain the base on the tool or the object and with a second axial coupling portion extending outwardly from another end of the clamping member and having an orifice so that the second axial coupling portion is axially connected between the two tabs of the base.

10. The controllable on/off device for the auxiliary light as claimed in claim 9, wherein between the two tabs of the base is defined a flexible locking portion, the second axial coupling portion of the clamping member has a plurality of engaging extensions arranged thereon, such that the locking portion of the base engages with the plurality of engaging extensions of the clamping member so that the light illumination angle of the lamp module is adjusted in a vertical direction.

* * * * *